United States Patent [19]

McBrayer

[11] 4,058,940

[45] Nov. 22, 1977

[54] SYNTHETIC MONUMENT MARKER

[75] Inventor: Doyle C. McBrayer, Kansas City, Mo.

[73] Assignee: Max Von Erdmannsdorff, Gladstone, Mo.

[21] Appl. No.: 666,643

[22] Filed: Mar. 15, 1976

[51] Int. Cl.[2] ..... E04H 13/00

[52] U.S. Cl. ..... 52/104; 52/105; 52/294; 52/309.12

[58] Field of Search ..... 52/309, 104, 103, 727, 52/294, 295, 725, 573, 105, 309.12; 40/124.5, 125, 135, 125 N; 256/13.1; 428/310, 322

[56] References Cited

U.S. PATENT DOCUMENTS

| | | | |
|---|---|---|---|
| 1,197,810 | 9/1916 | Flack | 52/104 |
| 3,429,758 | 2/1969 | Young | 52/725 |
| 3,938,286 | 2/1976 | Mochiwski | 52/103 |

FOREIGN PATENT DOCUMENTS

| | | | |
|---|---|---|---|
| 1,534,501 | 6/1970 | Germany | 404/10 |

*Primary Examiner*—John E. Murtagh

*Attorney, Agent, or Firm*—Lowe, Kokjer, Kircher

[57] ABSTRACT

A monument marker is formed with a clear plastic outer laminate and an inner concrete core. The space between the outer laminate and the core is filled with urethane foam to accommodate expansion and contraction of the concrete core. The outer laminate is formed in either one or two pieces by casting or blow molding. After curing of the outer laminate, the concrete core is positioned centrally of the laminate shell in spaced relationship to the shell walls. The space between the core and the walls is then filled with an expandable liquid such as urethane foam. As the liquid expands it will completely fill the space in the shell and provide an area of rigid yet yieldable material capable of responding to contraction and expansion of the concrete. Indicia presenting a name or message may be secured inside the clear plastic laminate before filling with the expandable liquid. The expanded material is trimmed to present a smooth base and a sheet of plastic may be secured to seal the shell. Anchor bolts are provided projecting from the concrete core to provide means for securing the marker to a base.

3 Claims, 3 Drawing Figures

SYNTHETIC MONUMENT MARKER

This invention relates to outdoor markers and, more particularly, to an outdoor marker constructed from manmade materials, although characterized by a permanency approaching that of natural materials such as granite.

Grave markers and other types of monument markers have traditionally been constructed from natural stone such as granite. These materials have become very nearly prohibitive in cost because of the great amount of labor which must be utilized to shape, polish, and finally engrave the stone with the desired indicia.

Another disadvantage of traditional granite markers is their susceptibility to chipping and marring, particularly as a result of acts of vandalism. While granite markers are extremely heavy, it is possible for them to be tipped over and they are also subject to vandalism in this form. It is virtually impossible to embed any type of anchor in a granite stone marker which would positively preclude its being turned over.

A primary object of the present invention is to provide a marker made of synthetic materials which will have the weight and permanency of granite stone markers as a result of a concrete inner core and a protective outer laminate of plastic.

Another object of this invention is to provide a monument marker which includes another structure projecting from it that may be secured to or embedded in a permanent base so as to positively preclude any tipping of the marker.

As a corollary to the above object, an important aim of the invention is to provide a monument marker having the appearance advantages, permanency and weight of a granite marker yet which is more economical to manufacture.

Another important objective of this invention is to provide a monument marker wherein the indicia displaying a name or message may be positioned beneath the outer protective plastic laminate so as to preclude any possible damage to the indicia.

Another objective of the invention is to provide a monument marker which is economical to construct on a high volume production basis in a form which is easy to ship and handle.

Other objects of the invention will be made clear or become apparent from the following description and claims when read in light of the accompanying drawing wherein:

One type of monument marker known in the prior art is shown in U.S. Pat. No. 2,124,143 to Long. The Long marker is made of synthetic material but does not provide for a concrete insert to give the marker the necessary weight. Even if such a concrete insert was substituted into the Long marker (although not suggested by the patent), it would be likely to break the outer cover since no provision for expansion and contraction of the concrete is made.

Figure 1:
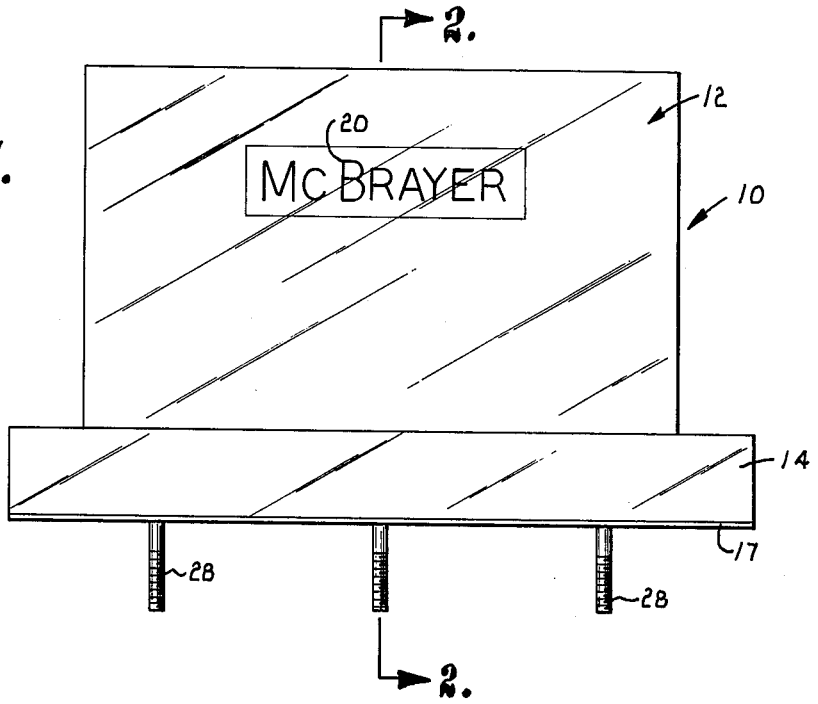
FIG. 1 is a side elevational view of a monument marker constructed according to the teachings of the present invention.
Figure 2:
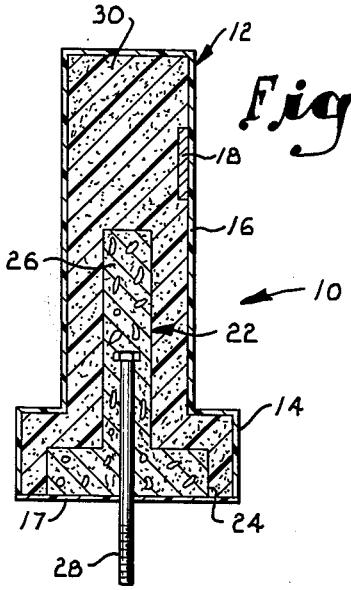
FIG. 2 is a vertical cross-sectional view of the marker taken along line 2—2 of FIG. 1.

Referring initially to FIGS. 1 and 2, the monument marker of the present invention is designated generally by the numeral 10 and comprises an outer laminate 12 of at least translucent and preferably transparent plastic. Outer laminate 12 comprises a bottom section 14 of spaced apart side walls and a top section 16 characterized by side walls which are more closely spaced than the walls of the bottom section. The two sections 14 and 16 cooperate to present a hollow shell conforming to the desired configuration for the marker.

A plate 18 is adhesively secured to the inside surface of one wall of top section 16. As can be seen in FIG. 1, palte 18 carries indicia 20 displaying a name which is, of course, the function of the marker.

A concrete aggregate insert is designated generally by the numeral 22 and is placed within the hollow shell presented by the outer laminate 12. Insert 22 is poured and allowed to set up before it is placed within the shell and is designed to conform generally to the configuration of the outer laminate. A base section 24 is disposed entirely within the bottom section of the outer laminate and an upper section 26 projects up into the top section 16 of the outer laminate. Both of the sections 24 and 26 are smaller in dimension than the corresponding sections of the outer laminate so as to be located in spaced relationship to the laminate walls when inserted within the shell. It is desirable to provide anchor bolts 28 or some other form of anchoring means embedded within the concrete insert. The purpose of these anchor bolts will be explained more fully hereinafter.

The area between the concrete insert 22 and outer laminate 12 is occupied by a cellular material such as a rigid polyurethane foam designated by the numeral 30 in FIG. 2. This material allows for expansion and contraction of insert 22 without damage to outer laminate 12.

Figure 3:
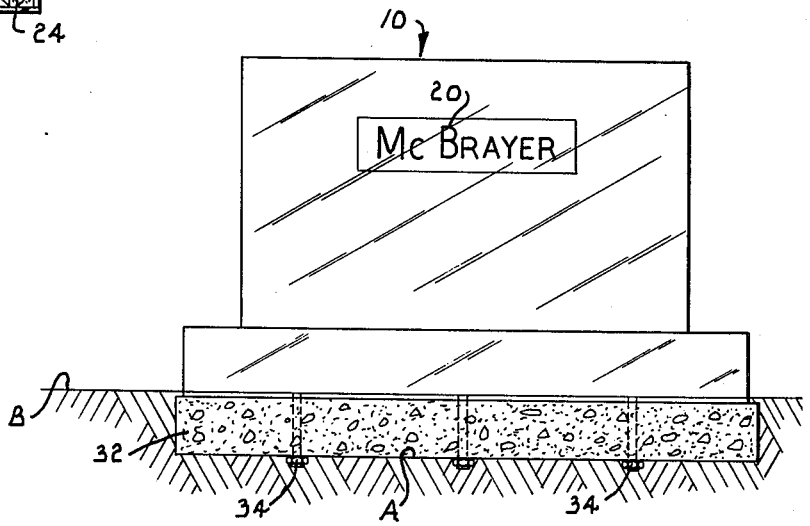
FIG. 3 is another elevational view, on a reduced scale, illustrating the manner in which the marker of the present invention may be secured to a concrete base to give it added weight.

It is often desirable to secure marker 10 to a concrete base such as that designated by the numeral 32 in FIG. 3. Concrete base 32 is provided with openings (not shown) through which bolts 28 may project with an end of the bolt being exposed for fastening a nut 34. The combined marker structure and concrete base may then be set upon a concrete foundation, the surface of which is designated by the reference letter A. Surface A would normally be disposed beneath ground level B sufficiently so that the entire concrete base 32 is hidden from view.

In constructing the marker structure of the present invention, a moldable plastic such as an acrylic plastic is preferably utilized. The plastic material is either cast into a mold of an appropriate configuration or any one of several known blow molding techniques may be utilized. It is possible to mold the shell formed by outer laminate 12 in either a one-piece construction or in two pieces which are secured together either adhesively, through the use of heat, ultrasonic welding or other known techniques. Once the outer laminate has been formed to the desired configuration, an appropriate indicia plate such as 18 is preferably adhesively secured to the inner surface of the outer laminate. Manifestly, artistic renderings of flowers and other ornamental designs can also be placed beneath the outer laminate. In some instances it may be desirable to preserve natural dried flowers beneath the clear plastic laminate. When the indicia and any accompanying ornamentation are in place, the concrete insert 22 is positioned in spaced relationship to the side walls of the shell. The concrete insert has previously been formed in the desired configuration utilizing known techniques. Bolts 28 or other anchor means are embedded in the concrete insert at the time it is formed. Bolts 28 may also be used to rigidly secure the concrete insert in a mold in proper spaced relationship to the side walls of the outer shell. This will prevent the concrete insert from moving under the pressure of the expanding liquid. A foamable material such as liquid urethane is then introduced into the cavity presented by the shell of the outer laminate and is permitted to expand to completely occupy the space between the side walls of the laminate and the concrete insert. Once the material is completely expanded, it is trimmed at the bottom so as to permit bottom wall 17 to be secured to the bottom section 14. Bottom wall 17 may be adhesively or otherwise secured so as to completely seal the interior of the marker structure.

It will be appreciated that substantial advantages are offered by the marker construction of the present invention. The weight provided by the concrete insert 22 is advantageous in increasing the strength of the marker and also simulating the weight of granite or other stone-like materials which have been the traditional means of constructing monuments. With anchor bolts 28 secured to base 32, it is virtually impossible to turn over the marker of the present invention. If it is desired to secure the marker structure in even a more permanent fashion, however, bolts 28 or other types of anchors may be permitted to project from the bottom of the structure and then positioned for the pouring of concrete several feet deep around the marker structure. This will absolutely prevent any possibility of tipping of the marker.

It is also possible with the marker strucure of the present invention to place names or an appropriate message on the marker after it is inplace. This may be accomplished by a semi-skilled technician operating with a heated knife to cut an opening in the outer laminate and embed an indicia plate in an appropriate sized, hollowed out cavity of the foam 30. The outer surface may then be restored by sealing a layer of plastic of the same type and thickness as the original side walls over the newly placed name plate. If proper techniques are followed, the seal of the outer laminate is easily restored and the appearance of the marker is not adversely affected.

Having described the invention, I claim:

1. Structure for displaying a name or message comprising:

a concrete core;

an outer laminate of moldable plastic;

a layer of rigid foam between said concrete core and said outer laminate;

indicia means adjacent said laminate of moldable plastic for presenting a name or message; and anchor means embedded in said concrete and projecting from the bottom of said core for securing said structure.

2. Structure as set forth in claim 1, wherein said outer laminate comprises a translucent material.

3. Structure as set forth in claim 1, wherein is included a concrete base adapted to be coupled with said anchor means.

* * * * *